US005800973A

United States Patent [19]

Anderson et al.

[11] Patent Number: 5,800,973

[45] Date of Patent: Sep. 1, 1998

[54] BACKING LAYERS FOR IMAGING ELEMENTS CONTAINING HARD FILLER PARTICLES AND CROSSLINKED, ELASTOMERIC MATTE BEADS

[75] Inventors: Charles C. Anderson, Penfield; Andy H. Tsou, Pittsford; Paul E. Woodgate, Spencerport, all of N.Y.

[73] Assignee: Eastman Kodak Company, Rochester, N.Y.

[21] Appl. No.: 847,634

[22] Filed: Apr. 28, 1997

[51] Int. Cl.[6] ..... G03C 1/93; G03C 1/81; G03C 1/76; G03C 11/06

[52] U.S. Cl. ..... 430/537; 430/527; 430/531; 430/536; 430/950; 430/961; 563/227

[58] Field of Search ..... 430/527, 537, 430/961, 950, 531, 536, 201; 503/227

[56] References Cited

U.S. PATENT DOCUMENTS

| | | | |
|---|---|---|---|
| 3,525,621 | 8/1970 | Miller | 430/527 |
| 4,442,164 | 4/1984 | Briggs et al. | 428/283 |
| 4,705,746 | 11/1987 | Tamagawa et al. | 430/538 |
| 4,997,735 | 3/1991 | Nitschke et al. | 430/22 |
| 5,008,178 | 4/1991 | Van Thillo et al. | 430/531 |
| 5,066,572 | 11/1991 | O'Connor et al. | 430/537 |
| 5,156,178 | 10/1992 | Harris | 137/43 |
| 5,244,728 | 9/1993 | Bowman et al. | 430/529 |
| 5,248,558 | 9/1993 | Bagchi et al. | 430/537 |
| 5,300,676 | 4/1994 | Andree et al. | 560/56 |
| 5,340,626 | 8/1994 | Anderson et al. | 430/527 |
| 5,366,855 | 11/1994 | Anderson et al. | 430/523 |
| 5,447,832 | 9/1995 | Wang et al. | 430/524 |
| 5,494,738 | 2/1996 | Van Thillo et al. | 430/527 |
| 5,538,935 | 7/1996 | Hastreiter, Jr. et al. | 503/227 |
| 5,547,821 | 8/1996 | Melpolder et al. | 430/527 |
| 5,561,034 | 10/1996 | Desie et al. | 430/537 |
| 5,597,680 | 1/1997 | Wang et al. | 430/523 |
| 5,597,681 | 1/1997 | Anderson et al. | 430/523 |

*Primary Examiner*—Richard L. Schilling
*Attorney, Agent, or Firm*—Carl F. Ruoff

[57] ABSTRACT

The present invention is an imaging element which includes a support, an image forming layer and a backing layer. The backing layer includes a film forming polymeric binder, hard filler particles in an amount of from 10 to 80 volume percent of the backing layer, and crosslinked elastomeric matte beads having a glass transition temperature of 10° C. or less.

11 Claims, No Drawings

BACKING LAYERS FOR IMAGING ELEMENTS CONTAINING HARD FILLER PARTICLES AND CROSSLINKED, ELASTOMERIC MATTE BEADS

CROSS REFERENCE TO RELATED APPLICATIONS

This application relates to commonly assigned copending application Ser. No. 848,115, Express Mail No. EM059243869US filed simultaneously herewith and hereby incorporated by reference for all that it discloses.

FIELD OF THE INVENTION

This invention relates in general to imaging elements such as, for example, photographic elements and in particular to imaging elements comprising a support, an image-forming layer and a backing layer. More specifically, this invention relates to such imaging elements which have an improved backing layer exhibiting superior physical properties. The backing layer contains a film-forming binder, hard filler particles, and crosslinked, elastomeric matte beads.

BACKGROUND OF THE INVENTION

The imaging elements to which this invention relates can be of many different types depending on the particular use for which they are intended. Such elements include, for example, photographic, electrophotographic, electrostatographic, photothermographic, migration, electrothermographic, dielectric recording and thermal-dye-transfer imaging elements.

Layers of imaging elements other than the image-forming layer are commonly referred to as auxiliary layers. There are many different types of auxiliary layers such as, for example, subbing layers, backing layers, overcoat layers, receiving layers, stripping layers, antistatic layers, transparent magnetic layers, and the like.

One typical application for such an auxiliary layer is as a backing layer to provide resistance to scratches and abrasion. Such backing layers often contain matte beads in order to prevent blocking, ferrotyping, and the formation of Newton rings when the backside of the imaging element is in contact with other surfaces such as the imaging side of the element steel or rubber rollers, and glass or metal surfaces during the manufacture, storage, and use of the element. For imaging elements used in the Graphic Arts industry, matte beads contained in the backing layer facilitate the use of a vacuum contacting process that is used in the printing and duplicating of images as described in U.S. Pat. No. 4,997,735.

Backing layers may be applied directly onto the support material, applied onto a priming or "subbing" layer, or applied as an overcoat for an underlying layer such as an antistatic layer, transparent magnetic layer, or the like. When the backing layer is an overcoat for an antistatic layer the backing layer may need to protect the antistatic layer from attack by film processing solutions in order to preserve the antistatic properties of the film after image processing.

The need to provide separate electroconductive and backing layers increases both manufacturing complexity and cost. In addition, while a two-layer backing provides good protection against static-related problems, it is most effective to utilize an electroconductive material in a surface layer rather than in an interior layer that is overcoated with an insulating material (that is, the conductive layer is a "buried" layer). In the former case it is possible for surface charges to be dissipated by conduction of charge across the conductive surface to a ground plane. A buried conductive layer may only transform free charge to polar charge (the term "polar charge" refers to the presence of equal and opposite charge on the two surfaces of a dielectric sheet) by imaging (with an equal and opposite charge) the triboelectric charge created on the contacted surface. This charge imaging process can reduce the distance at which an electric field can be measured (for example, with a field meter) to a distance on the order of the thickness of the imaging element. Thus for example, a dirt particle at a long distance from the imaging element is unlikely to be attracted to the film as a result of electrostatic attraction. However, foreign objects or other sheets of film that are in direct contact with the imaging element containing the image charge are very likely to be subject to the electric field. Thus charge dissipation via a conductive outermost layer is the most effective way to provide protection against static-related problems.

Backing layers may be made electroconductive by the incorporation of electronically-conductive inorganic fine particles. Representative conductive particles that have been employed for this purpose include doped-metal oxides, metal oxides containing oxygen deficiencies, metal antimonates, conductive nitrides, carbides, or borides. A backing layer containing such conductive particles for use in thermographic imaging has been described in U.S. Pat. No. 5,547,821. Ionically-conductive sols such as colloidal silica, zirconia, tin oxide, etc. have also been added to backing layers as described in U.S. Pat. Nos. 3,525,621, 4,442,164, 4,705,746, 5,008,178, 5,156,707, 5,244,728, 5,494,738, and many others.

Non-conductive, hard fillers may also be added to backing layers to improve, for example, abrasion resistance, blocking resistance, or pencil writability. Such fillers include high Tg polymer particles such as the non-film-forming polymer particles taught in U.S. Pat. Nos. 5,366,855 and 5,447,832 or non-conductive inorganic fillers such as silicas or clays.

As pointed out in the preceding discussion it is highly desirable to employ both hard fillers and matte beads in a backing layer when it serves as the outermost layer of an imaging element. However, the incorporation of hard fillers in a thin backing layer creates a serious problem with respect to adherence of matte beads. Backing layers that contain high concentrations of hard fillers are very stiff and non-compliant. Such layers also have a reduced concentration of film forming binder to adhere to the matte beads. When such backing layers contact surfaces during the manufacture and use of the imaging element the matte beads may be dislodged from the backing layer and create a fine dust of particles that can be attracted to or imbedded in the imaging layer. This may result in serious image defects in the imaging element.

It is toward the objective of providing an improved backing layer containing hard filler particles and matte beads that the present invention is directed.

SUMMARY OF THE INVENTION

The present invention is an imaging element which includes a support, an image forming layer and a backing layer. The backing layer includes a film forming polymeric binder, hard filler particles in an amount of from 10 to 80 volume percent of the backing layer, and crosslinked elastomeric matte beads having a glass transition temperature of 10° C. or less.

DETAILED DESCRIPTION OF THE INVENTION

The imaging elements of this invention can be of many different types depending on the particular use for which they are intended. Details with respect to the composition and function of a wide variety of different imaging elements are provided in U.S. Pat. No. 5,300,676 and references described therein.

Photographic elements can comprise various polymeric films, papers, glass, and the like, but both acetate and polyester supports well known in the art are preferred. The thickness of the support is not critical. Support thickness of 2 to 10 mil (0.002 to 0.010 inches) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer.

The backing layers of the present invention comprise a film-forming polymeric binder, hard filler particles, and elastomeric matte beads. The backing layers of the invention may be applied from either aqueous or solvent coating compositions. The film-forming binder used in the present invention is not critical, binders that may be effectively employed include interpolymers of ethylenically unsaturated monomers such as acrylic acid and its esters, methacrylic acid and its esters, styrene and it derivatives, vinyl chloride, vinylidene chloride, butadienes; maleic acid, itaconates, vinyl pyrrolidone, acrylamides and methacrylamides, and the like. Other useful binder polymers include gelatin, polyvinyl alcohol, polyvinyl butyral, cellulosics, polyurethanes, polyesters, epoxies, and the base neutralized, carboxylic acid-containing latex polymers described in the commonly assigned copending application Ser. No. 712,006, filed Sep. 11, 1996.

Various hard filler particles may be used in the backing layer of the present invention depending on the requirements for the backing layer. For example, when the backing layer serves as an electrically-conductive layer the hard filler particles may be inorganic conductive fine particles. Representative conductive particles include doped-metal oxides, metal oxides containing oxygen deficiencies, metal antimonates, conductive nitrides, carbides, or borides, for example, $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC. Also included are ionically-conductive sols such as colloidal $SiO_2$, $SnO_2$, $TiO_2$ and others.

Nonconductive backing layers may utilize nonconductive filler particles to improve the physical properties of the backing layer such as resistance to ferrotyping, blocking, abrasion, and scratches. These filler particles include inorganic fillers such as silicas, clays, mica, etc. and high Tg polymer particles such as the solvent dispersible polymer particles described in U.S. Pat. Nos. 5,597,680 and 5,597,681 and the non-film-forming polymer particles described in U.S. Pat. Nos. 5,366,855 and 5,447,832.

The backing layer of the present invention contains 10 to 80 volume percent of hard filler. At filler concentrations less than 10 volume percent matte bead adherence is not usually a problem regardless of whether the matte bead is elastomeric or not Backing layers containing more than 80 volume percent filler particles are not desirable since they will have poor physical properties such as brittleness and poor adhesion. The filler concentration is specified in terms of volume percent rather than weight percent since the density of the filler particles can vary widely, for example, from about 1.2 $g/cm^3$ for high Tg polymeric fillers to 7 $g/cm^3$ for metal oxide fillers.

In contrast to prior art backing layers which utilize matte beads which are harder and have a higher Tg, it has been found that the elastomeric matte beads of the invention which have a lower Tg are resilient, therefore when the backing layer comes into contact with, for example, a roller or other hard surface, the force exerted on the matte beads temporarily deforms the bead. When matte beads having a high Tg are used, the matte beads are too rigid to deform and contact with a hard surface dislodges the matte bead. The crosslinked, elastomeric matte beads employed in the invention have a Tg of 10° C. or less, preferably 0° C. or less.

Another advantage when crosslinked, elastomeric matte beads are used according to the present invention is that they are less likely to cause scratches in the imaging layer when the front and back sides of the imaging element are brought into contact during the manufacture or use of the element. When inelastic, low Tg matte beads are used which are not partially crosslinked, they will permanently deform when the backing layer is exposed to high temperatures and pressures, for example, during the manufacturing process or when the imaging element is stored in roll form. Thus such matte beads are not desirable in the present invention.

Matte bead elasticity is determined by the amount of crosslinking agent employed in making the matte bead. If the amount of crosslinking agent used is too high, the matte beads produced will be too rigid. If the amount of crosslinking agent in the matte beads is too low, the matte beads will not only be deformed under pressure, but will also undergo nonelastic flow leading to permanent deformation, making recovery of their original shape impossible.

Thus, the crosslinked, elastomeric matte beads used in the invention have a combination of both the proper Tg and level of crosslinking agent in order to achieve the desired degree of elasticity.

The crosslinked, elastomeric matte beads may be employed in any amount effective for the intended purpose. In general, good results are obtained at a coverage of from about 0.5 to about 250 $mg/m^2$. The crosslinked, elastomeric matte beads generally have a particle size of from about 0.5 μm to about 20 μm.

In a particularly preferred embodiment, the crosslinked, elastomeric beads used in the invention are made from an interpolymer of ethylenically unsaturated monomers such as acrylic or methacrylic acid and their esters such as butyl-, ethyl-, propyl-, hexyl-, 2-ethyl hexyl-, 2-chloroethyl-, 4-chlorobutyl- or 2-ethoxyethyl-acrylate or methacrylate, hydroxyethyl acrylate or hydroxyethyl methacrylate, styrene and its derivatives, butadienes, ethylene, propylene, vinyl chloride, vinylidene chloride, itaconic acid and its esters, and the like.

The crosslinked, elastomeric beads may also comprise polycondensation products such as polyurethanes, polysiloxanes, polyesters, and polyethers. The beads may also be prepared from natural and synthetic rubbers such as those described in "Rubber Technology", Werner Hofmann, Hansen Publishers, New York, 1989. Such rubber materials include polyisoprene, fluoroelastomers, epichlorohydrin rubbers, polypropylene oxide rubbers, chlorinated polyethylene rubbber, natural rubber, and the like.

The elastomeric beads may be crosslinked with various crosslinking agents, which may also be part of the elastomeric interpolymer, such as divinylbenzene, ethylene glycol diacrylate, ethylene glycol dimethacrylate, 1,4-cyclohexylene-bis(oxyethyl) dimethacrylate, 1,4-cyclohexylene-bis(oxypropyl) diacrylate, 1,4-cyclohexylene-bis(oxypropyl) dimethacrylate, etc. The crosslinked, elastomeric matte beads may contain reactive functional groups capable of forming covalent bonds with the binder polymer by intermolecular crosslinking or by reaction with a crosslinking agent in order to promote further improve adhesion of the matte beads to the coated layers. Suitable reactive functional groups include: hydroxyl, carboxyl, carbodiimide, epoxide, aziridine, vinyl sulfone, sulfinic acid, active methylene, amino, amide, allyl, and the like. It is preferred that the elastomeric beads contain greater than 3 percent by weight of a crosslinking agent, most preferably from 3 to 40 percent by weight of a crosslinking agent.

U.S. Pat. No. 5,538,935 describes the use of crosslinked, elastomeric beads in the dye-receiving layer or the dye-receiving layer overcoat for thermal dye transfer materials. The elastomeric beads have a Tg of less than 45° C. and are compressed under the weight of the thermal print head during printing, thereby allowing better contact between the dye-donor and dye-receiver elements. The '935 patent does not teach or suggest the benefit with respect to matte bead adherence of using crosslinked, elastomeric matte beads having a Tg less than 10 ° C. in backing layers containing hard filler particles. In the present invention the matte bead Tg needs to be lower than the '935 patent since the function of the matte bead is different. In the '935 patent the matte bead must deform to allow closer contact between the donor and receiver material under the high temperatures that exist in the thermal dye transfer process.

In addition to the binder polymer, hard filler particles, and crosslinked, elastomeric matte beads, the backing layers in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with the functional groups present on the polymeric binder or the crosslinked, elastomeric matte beads present in the coating composition.

Other additional compounds that can be employed in the backing layer compositions of the invention include surfactants, coating aids, coalescing aids, lubricants, dyes, biocides, UV and thermal stabilizers, and other addenda well known in the imaging art.

The backing layer compositions of the present invention may be applied at up to 20% total solids by coating methods well known in the art. For example, hopper coating, gravure coating, skim pan/air knife coating, spray coating, and other methods may be used with very satisfactory results. The coatings are dried at temperatures up to 150° C. to give total dry coating weights of 20 mg/m$^2$ to 10 g/m$^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Magnetic layers suitable for use in the elements in accordance with the present invention include those as described in Research Disclosure, November 1992, Item 34390, and U.S Pat. Nos. 5,395,743, 5,397,826, 5,113,903, 5,432,050, 5,434,037 and 5,436,120.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The following examples are used to illustrate the present invention. However, it should be understood that the invention is not limited to these illustrative examples.

EXAMPLES

Preparation of crosslinked, elastomeric matte bead

A limited coalescence process (described in U.S. Pat. Nos. 4,965,131 and 5,133,912) was used to prepare matte beads containing the appropriate monomers. The specific procedure for making crosslinked, elastomeric matte beads comprising poly(n-butyl acrylate-co-ethylene glycol diacrylate) (95/5) was as follows:

A monomer mixture of 475 g n-butyl acrylate, 25 g ethylene glycol diacrylate, and 5 g Vazo 52 (an azo-initiator from DuPont) was combined with a mixture of 3.7 g poly(methylaminoethanol adipate), and 30 g Ludox Tmdispersing agent (available from Dupont) in 1.5 L water. The mixture was stirred rapidly with a laboratory stirrer to obtain a crude emulsion. The crude emulsion was then passed through a Gaulin Homogenizer to obtain 7.5 μm monomer droplets in water. The resulting suspension was heated at 49° C. overnight in a 5 L flask to polymerize the monomer droplets. These crosslinked, elastomeric matte beads are designated B-1.

Crosslinked, elastomeric matte beads, designated B-2, comprising poly(ethyl acrylate-co-ethylene glycol dimethacrylate) 95/5 were prepared in an analogous manner. These matte beads have a mean particle diameter of about 3 μm and a Tg equal to 7.5° C.

Comparative crosslinked matte beads, designated C-1, comprising poly(methyl methacrylate-co-divinyl benzene) (97/3) having a Tg of greater than 100° C. and a particle size of 8 μm were prepared in a similar manner. These crosslinked, matte beads are hard and are not elastomeric.

Comparative crosslinked matte beads, designated C-2, comprising poly(n-butyl methacrylate-co-ethylene glycol dimethacrylate) 95/5 and having a particle size of 3 μm and a Tg of 38° C. were also prepared. These matte beads are comparable to those taught in U.S. Pat. No. 5,538,935 which describes crosslinked, elastomeric matte beads with a Tg less than 45° C.

Examples 1 to 6 and Comparative Samples A to F

Backing layers comprising a water dispersible polyurethane (Witcobond 232, Witco Corp.), colloidal silica (Ludox AM, DuPont Specialty Chemicals), and crosslinked, matte beads were applied onto a subbed polyester support at a total dry coverage of 1000 and 3000 mg/m$^2$. The coatings contained 10 mg/m$^2$ of matte beads and 15, 35, and 60 volume % colloidal silica. The coatings were evaluated for adherence of the matte bead in the coating by the following test. Sample strips were conveyed over a 1 inch diameter smooth, non-rotating stainless steel rod under constant tension produced by hanging a 500 gram weight to the end of the sample. The samples were conveyed such that the backing layer was in contact with the stainless steel rod. The matte beads dislodged during the test were collected on a piece of dark paper and the amount of particles dislodged were rated on a scale of 1.0 to 4.0, the higher the number the more matte beads were dislodged. The results obtained are summarized in Table 1.

TABLE 1

| Sample | Matte Bead | Total Coverage mg/m$^2$ | Volume % Colloidal Silica | Rating |
|---|---|---|---|---|
| Sample A | C-1 | 1000 | 15 | 2.0 |
| Sample B | C-1 | 3000 | 15 | 4.0 |
| Sample C | C-1 | 1000 | 35 | 4.0 |
| Sample D | C-1 | 3000 | 35 | 4.0 |
| Sample E | C-1 | 1000 | 60 | 4.0 |
| Sample F | C-1 | 3000 | 60 | 4.0 |
| Example 1 | B-1 | 1000 | 15 | 1.5 |
| Example 2 | B-1 | 3000 | 15 | 1.5 |
| Example 3 | B-1 | 1000 | 35 | 1.5 |
| Example 4 | B-1 | 3000 | 35 | 2.0 |
| Example 5 | B-1 | 1000 | 60 | 1.5 |
| Example 6 | B-1 | 3000 | 60 | 1.5 |

It can be seen from the results that backing layers comprising hard fillers and conventional crosslinked, matte beads have very poor performance with respect to adherence of the matte beads. However, when crosslinked, elastomeric matte beads are employed in coatings of the invention, the coatings exhibit excellent performance even at very high concentrations of the hard filler particles.

Examples 7 to 9 and Comparative Samples G to I

Backing layers comprising the polyurethane binder and colloidal silica described in the previous examples and matte beads B-2 and C-2 were applied onto a subbed polyester support at a total dry coverage of 1000 mg/m$^2$. The coatings contained 10 mg/m$^2$ of matte beads and 15, 35, and 60 volume % colloidal silica. The coatings were evaluated for adherence of the matte beads as previously described. The results are reported in Table 2. It can been seen that matte beads of the invention have superior adhesion to backing layers containing hard fillers compared to crosslinked, elastomeric matte beads taught in the '935 patent.

TABLE 2

| Sample | Matte Bead | Volume % Colloidal Silica | Rating |
|---|---|---|---|
| Sample G | C-2 | 15 | 2.5 |
| Sample H | C-2 | 15 | 4.0 |
| Sample I | C-2 | 35 | 4.0 |
| Example 7 | B-2 | 15 | 1.5 |
| Example 8 | B-2 | 15 | 1.5 |
| Example 9 | B-2 | 35 | 1.0 |

The invention has been described in detail with particular reference to certain preferred embodiments thereof, but it will be understood that variations and modifications can be effected within the spirit and scope of the invention.

What is claimed is:

1. An imaging element comprising a support, an image forming layer superposed on a front side of the support and a backing layer superposed on a backside of the support comprising a film forming polymeric binder, hard filler particles in an amount of from 10 to 80 volume percent of said backing layer wherein the hard filler particles are selected from the group consisting of inorganic conductive fine particles, ionically-conductive sols silicas, clays, mica, and non-film-forming polymer particles, and crosslinked elastomeric matte beads having a glass transition temperature of 10° C. or less.

2. The imaging element of claim 1 wherein said film-forming binder is selected from the group consisting of interpolymers of ethylenically unsaturated monomers, gelatin, polyvinyl alcohol, polyvinyl butyral, cellulosics, polyurethanes, polyesters, epoxies, and base neutralized, carboxylic acid-contang latex polymers.

3. The imaging element of claim 1 further comprises an undercoat or subbing layer.

4. The imaging element of claim 1 wherein the crosslinked, elastomeric. beads comprise an interpolymer of ethylenically unsaturated monomers selected from the group consisting of acrylic acid, methacrylic acid, esters of acrylic acid, esters of methacrylic acid, styrene, derivatives of styrene, butadienes, vinyl chloride, vinyhdene chloride, itaconic acid and esters of itaconic acid.

5. The imaging element of claim 1 wherein the crosslinked, elastomeric beads comprise polycondensation products selected from the group consisting of polyurethanes, polysiloxanes, polyesters, and polyethers.

6. The imaging element of claim 1 wherein the backing layers further comprises crosslinking agents, surfactants, coating aids, coalescing aids, lubricants, dyes, biocides, UVstabilizers, and thermal stabilizers.

7. The imaging element of claim 1 wherein the crosslinked, elastomeric matte beads have a particle size of from about 0.5 μm to about 20 μm.

8. The imaging element of claim 1 further comprising a transparent magnetic layer.

9. The imaging element of claim 1 wherein the image forming layer comprises a silver halide light-senstive emulsion.

10. The imaging element of claim 1 wherein said support is selected from the group consisting of polymeric films, papers, and glass.

11. The imaging element of claim 1 wherein said support has a thickness of from 2 to 10 mil.

* * * * *